United States Patent [19]

Hama

[11] Patent Number: 4,685,602

[45] Date of Patent: Aug. 11, 1987

[54] PLASTIC-MOLD CUTTING APPARATUS USING SUPERSONIC WAVES

[75] Inventor: Tomio Hama, Okaya, Japan

[73] Assignee: Kabushiki Kaisha Harmo, Tokyo, Japan

[21] Appl. No.: 719,924

[22] Filed: Apr. 4, 1985

[30] Foreign Application Priority Data

Apr. 9, 1984 [JP] Japan ..... 59-71529

[51] Int. Cl.[4] ..... B26F 3/00

[52] U.S. Cl. ..... 225/93; 83/98; 83/535; 83/701; 225/1

[58] Field of Search ..... 83/13, 701, 534, 535, 83/98; 225/1, 93, 97; 51/59 SS

[56] References Cited

U.S. PATENT DOCUMENTS 1,091,707 3/1914 Reed ..... 83/534
2,467,546 4/1949 Anderson ..... 83/534 X
2,967,381 1/1961 Brown ..... 51/59 SS
3,031,804 5/1962 Thatcher et al. ..... 51/59 SS
3,595,453 7/1971 Sherry ..... 225/1

*Primary Examiner*—Frank T. Yost
*Assistant Examiner*—Hien H. Phan
*Attorney, Agent, or Firm*—Jordan and Hamburg

[57] ABSTRACT

A plastic-mold cutting apparatus using supersonic waves, equipped with a horn allowed to vibrate by supersonic waves from a supersonic oscillator, applies its horn on a plastic mold to cut the plastic mold at a prescribed position by use of the vibrational energy of the horn. An oscillating mechanism containing the supersonic oscillator and horn is provided stationary. A pressing element for pressing the mold placed on the horn is provided so as to be capable of moving in the direction toward the horn. The structure that the pressing element possible to be of light weight is designed to move, leads to decrease in size and weight of the apparatus and to establishment of an excellent oscillating system.

5 Claims, 7 Drawing Figures

PLASTIC-MOLD CUTTING APPARATUS USING SUPERSONIC WAVES

DESCRIPTION OF THE PRIOR ART

To get a plastic product, a plastic mold needs to get rid of its sprue-runner section indispendable for molding by cutting its gate section, i.e., the boundary between the runner section and the product.

The gate cutting has been carried out mechanically with nippers, etc., but recently a new gate cut method capable of giving good cut finish has been deveoloped by application of supersonic energy.

FIG. 1 shows the conventional plastic-mold cutting apparatus utilizing supersonic waves. A cutting apparatus proper 1 has a built-in supersonic oscillator for outputting supersonic waves, is supported on a support 3 fixed on a base 2 so as to be capable of sliding, and may be moved vertically by an air cylinder. A horn 4 is attached to the apparatus proper 1 via a booster 5. In using this cutting apparatus, a plastic mold is first set on a setter (not shown) fixed on the base 2, then the horn 4 together with the apparatus proper 1 is lowered so that the sprue-runner section of the mold located between the horn 4 and the setter, and finally supersonic vibrations are applied to cut the gate section between the runner section and the product. The product is, thereafter, removed from the apparatus.

This conventional apparatus is associated with such unfavorable requirements as are given below, which result essentially from the mechanism adopted that, as described above, the apparatus proper 1 is designed to move vertically along the support 3: (1) the apparatus proper 1 must be moved up and down stably without swings and accordingly the inside of the apparatus proper 1 needs to be provided with a slide mechanism in connection with the support 3; (2) the weight of the apparatus proper 1 is applied onto the horn 4 during gate cutting and accordingly various adjusting mechanisms need to be incorporated within the apparatus proper 1 lest the weight of the apparatus proper 1 has any efffect on the vibration of the horn 4. These unfavorable requirements lead necessarily to increase in volume and weight of the apparatus proper 1 as seen in FIG. 1.

The above-mentioned increase in volume and weight of the apparatus proper 1 in turn makes it necessary to use a strong, large-diameter rod of sufficient strength for the support 3, which further necessitates to make the base 2 large and heavy in order to support both the apparatus proper 1 and the support 3. It follows that the overall apparatus becomes considerably large and expensive.

The above requirement that the apparatus proper 1 should be heavy, raises another problem that the apparatus proper 1 is not permitted to move vertically with a long stroke, i.e., that it is difficult to make ample space available over the base 2. This makes difficult adoption of automation, for example, setting a mold taking-out device, designed to take molds out of a molding machine, so that between the molding machine and this cutting apparatus, a mold taking-out device is formed to deliver the mold directly onto the base 2. The difficulty in having ample space over the base 2 makes difficult another automation in which the sprue-runner section left after gate cutting is separated from the product and taken out.

The horn 4, which is fixed on the booster 5 and is depressed against the heavy base 2, results in a disadvantage that the vibration of the horn 4 cannot be transmitted so effectively to the base 2 or mold as to make the cutting performed with efficiency.

SUMMARY OF THE INVENTION

The major object of the present invention is to offer a plastic-mold cutting apparatus using supersonic waves which is small, light, inexpensive, and good in performance by adopting a structure in which the oscillatory mechanism comprising a supersonic oscillator, a booster, a horn, etc. is provided stationary, only a light pressing element serving to press the mold against the horn being allowed to move back and forth in the direction toward the horn.

The other object of the present invention is to offer a plastic-mold cutting apparatus using supersonic waves which is capable of easily taking out molds after gate cutting by adding to the light pressing element described above a mold holding mechanism and a pressing-element transfer mechanism.

SPECIFICATION OF THE INVENTION

Preferred embodiments of the present invention will be described in detail by reference to the accompanying drawings.

Figure 2:
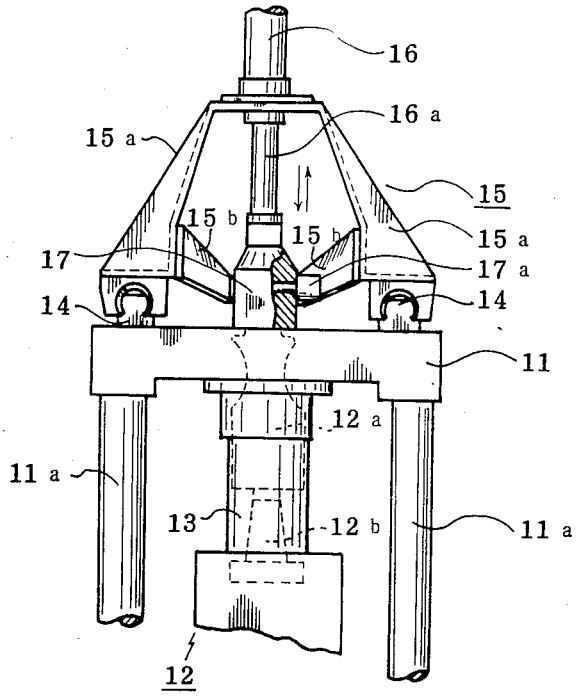
FIG. 2 is a front view of an apparatus according to the present invention.
Figure 3:
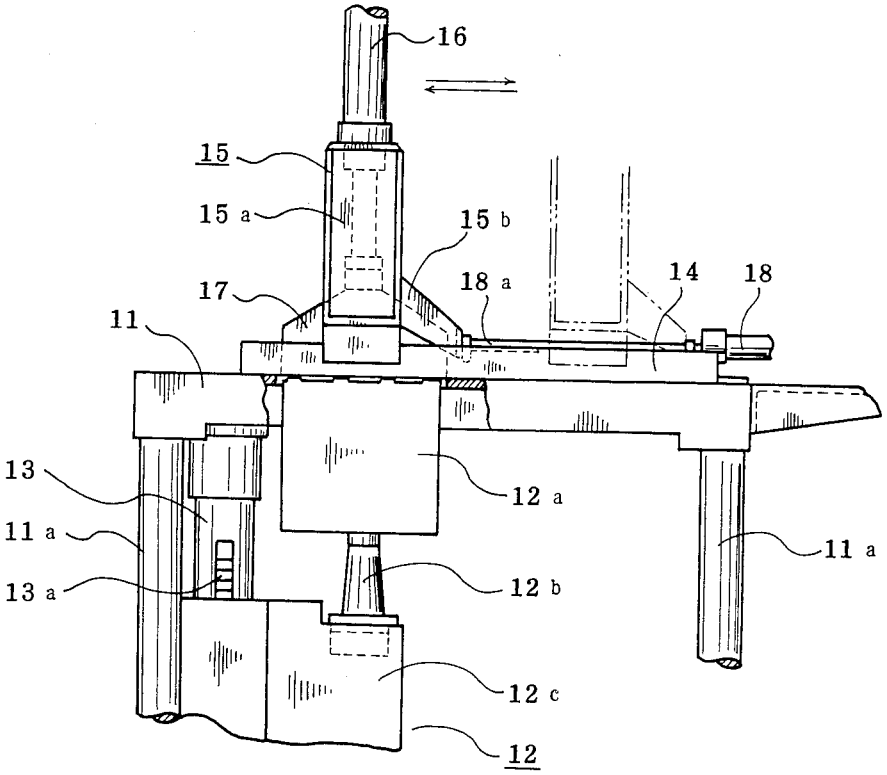
FIG. 3 is a side view of the apparatus of FIG. 2.

FIGS. 2 and 3 refer to the first embodiment of the present invention.

Referring to FIGS. 2 and 3, a base stand 11 is horizontally supported at a prescribed height by four legs 11*a*. A cutting mechanism 12 using supersonic waves comprises a horn 12*a* on which a mold to be subjected for gate cutting is to be placed, a booster 12*b* fixed under the horn 12*a*, and an oscillator proper 12*c* containing a built-in supersonic oscillator for vibrating the horn 12*a* via the booster 12*b*.

A support 13, with its upper end fixed on the base stand 11, extends downward, supporting the oscillator proper 12*c* capable of vertical movement. The upper face of the horn 12*a* is set almost flush with the upper face of the base stand 11. An adjuster 13*a* serves to adjust the height of the oscillator proper 12*c*.

Slide rails 14 are provided parallel to each other with the horn 12*a* positioned inbetween on the upper face of base stand 11.

A feeder 15, with its leg section 15*a* guided by the slide rail 14, may slide over and on both sides of the horn 12*a*.

An air cylinder has its lower section fixed on the upper section of the feeder 15, and its cylinder rod 16*a* may move back and forth in the direction toward the horn 12*a*.

A pressing element 17 is fixed at the lower end of cylinder rod 16*a* and serves to press a mold to be processed against the horn 12*a*.

An air cylinder 18 serves to move the feeder 15 laterally, and the front end of its cylinder 18*a* is fixed on a V-shaped catcher 15*b* projected from the side of the leg section 15*a* of the feeder 15.

The base stand 11 is provided with a hole (not shown) for dropping a product after gate cutting; a shoot connecting to this hole guides the product to a prescribed position.

The apparatus constructed as described above is operated as follows: First, the pressing element 17 is raised and the feeder 15 is moved to the right with respect to FIG. 3, thus preparing a space over the horn 12*a*. A mold taking-out device of a molding machine is then operated to place a mold to be processed onto the horn 12*a*. The air cylinder 18 is driven to move the feeder 15 toward the horn 12*c*, so that when the air cylinder 16 is driven to lower the pressing element 17, the mold is pressed against the horn 12*a*. Then, the air cylinder 16 is actuated to hold the mold between the pressing element 17 and the horn 12*a*. Finally, the horn 12*a* is allowed to vibrate by supersonic waves as in the conventional method; the mold is subjected to soften and fuse to cut at a prescribed position, i.e., the gate between the product and the sprue-runner section, and the product is allowed to drop through the hole on the base stand 11, the sprue-runner section being left on the horn 12*a*. The pressing element 17 goes up and the feeder 15 goes back, with one cycle of operation completed.

During the process of cutting, the molding is pressed between the stationary horn 12*a* and the small and light pressing element 17 and therefore the natural vibration of the horn 12*a* may be transmitted without disturbance to the set of the mold and the pressing element 17 with ready resonance among the three elements. Thus, if we previously position the upper face of the horn 12*a* at the point of maximum amplitude of the vibration, the largest vibrational energy may be transmitted to the mold, resulting in the most efficient cutting.

Figure 1:
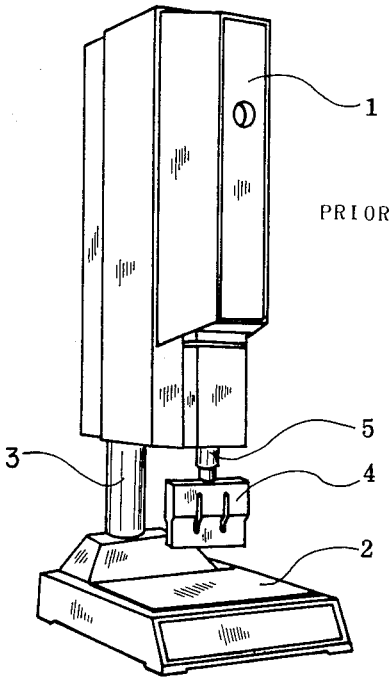
FIG. 1 is a perspective view illustrative of the conventional apparatus.

In the above respect, the conventional apparatus shown in FIG. 1 is inferior to the present one: In the former, the horn 4, designed to be pressed against the base which is large, heavy, and completely stationary, is impossible to bring the base 2 into resonance with itself, and accordingly the mold between the horn 4 and base 2 cannot either be brought into resonance, with resulting decreased efficiency of the tansmission of vibrational energy.

The cutting apparatus, according to the present invention, with a different oscillating mechanism is capable of successful cutting of those molds which the conventional apparatus failed to cut.

Figure 7:
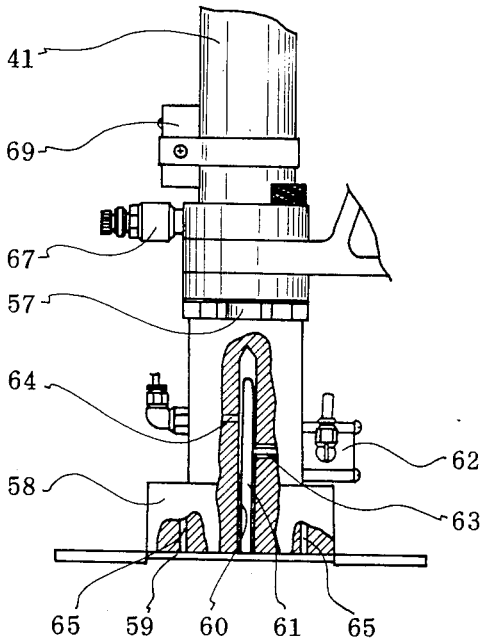
FIG. 7 is a partially-exposed plan illustrative of details of a pressing element.

The above-mentioned sprue-runner section left on the horn 12*a* after gate cutting may be held and lifted by a section driven by a cylinder 17*a* provided on the pressing element. Namely, the cylinder element 17 includes a hole, and the cylinder 17*a* includes a rod, as shown in FIG. 7. When a part of the sprue-runner section is inserted into the hold of the cylinder element 17, the sprue-runner section is caught by the rod of the cylinder 17*a*. The sprue-runner section is released and removed when the feeder 15 has reached the retire position. It is also possible to equip the pressing element 17 with a sucker which inhales air through a hole to lift the sprue-runner section therewith and drop it when the feeder 15 has reached the retire position.

When automation in connection with the molding machine is needed, e.g., when a robot is in charge of the feed of molds to be processed, such a structure is applicable, i.e., the feeder 15 is fixed on the base stand 11, the pressing element 17 being moved up and down toward the horn 12*a*. In such a case, the product after gate cutting is taken out by natural dropping through the hole on the base stand 11.

Figure 4:
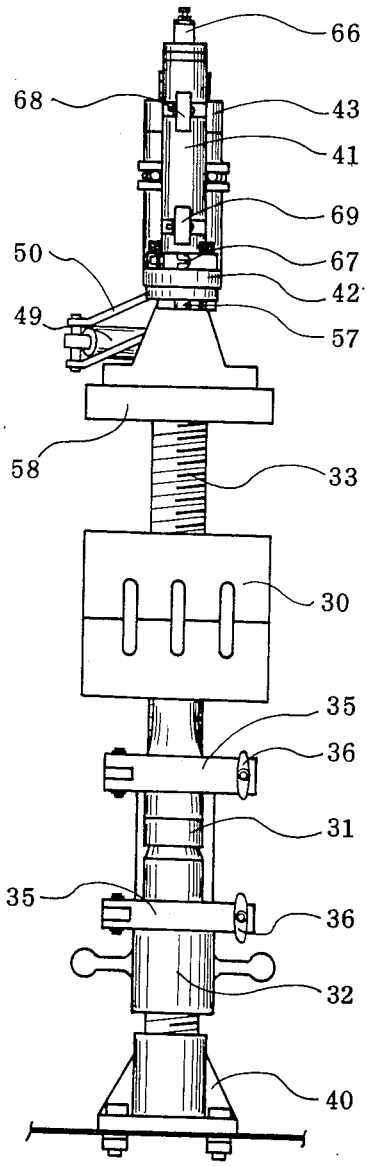
FIG. 4 is a front view of another apparatus according to the present invention.
Figure 5:
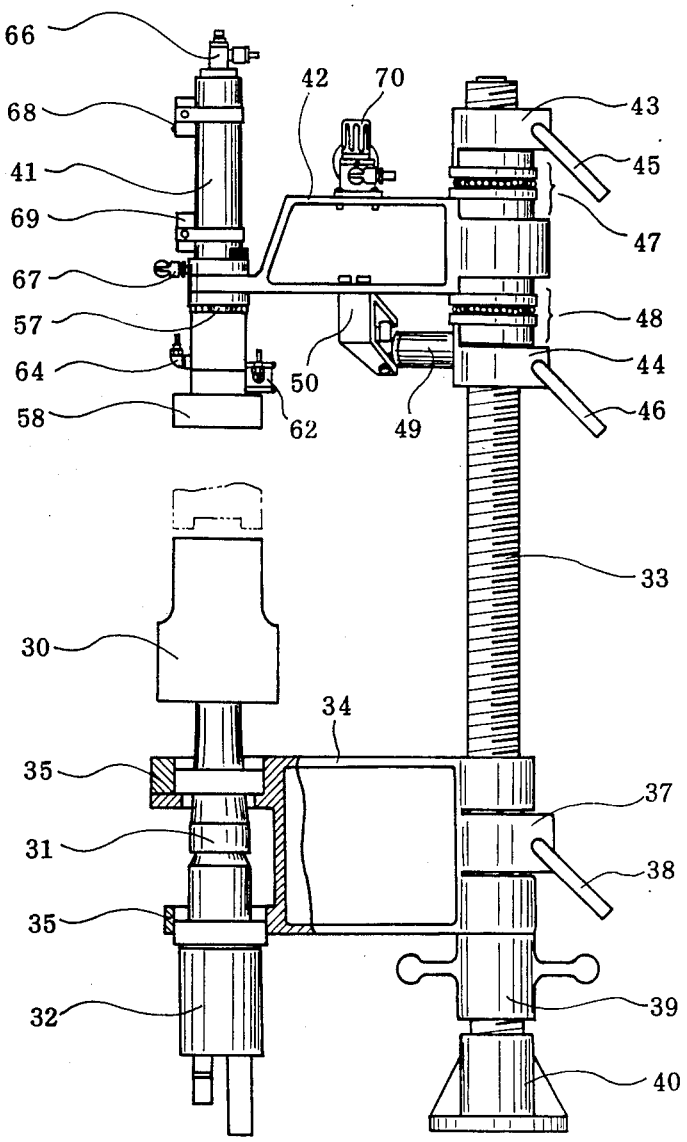
FIG. 5 is a side view of the apparatus of FIG. 4.
Figure 6:
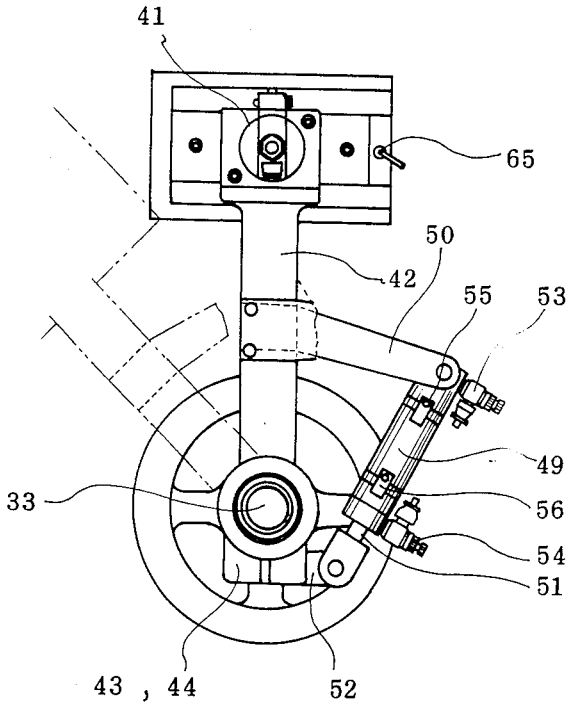
FIG. 6 is a plan of the apparatus of FIG. 4.

FIGS. 4–7 refer to the other embodiment of the present invention. FIGS. 4, 5, and 6 are a front view, a side view, and a plan view, respectively.

Referring to the figures, a horn 30 is connected to a supersonic oscillator 32 via a booster 31. The horn 30, the booster 31, and the supersonic oscillator 32 are set at one end of an arm 34 which is supported at the other end on a threaded rod 33 so as to be capable of swing. A locking door 35 is capable of open and close by means of wing nuts 36.

A 2-branch section 37 to catch the threaded rod 33 is provided on the base section of the arm 34, and the arm 34 may be fixed at any positions on the threaded rod 33 by use of a handle 38.

A nut 39 is for vertical adjustment of the position of arm 34; this arm 34 is caused to change its position by loosening the handle 38 and turning the nut 39.

A fixing element 40 is fixed at the lower end of the threaded rod 33 and is caused to set the threaded rod at a suitable position.

A mold-pushing cylinder 41 is fixed vertically at the front end of a swing arm 42 whose back end is supported at the upper part of the threaded rod 33 so as to be cap ible of swing.

Holding elements 43 and 44 are each in the form of 2-branch arm capable of pinching the threaded rod 33. They are fixed on the threaded rod 33 by application of handles 45 and 46.

The swing arm 42 can be rotated and vertically moved relative to the threaded rod 33 by the application of the two holding elements 43 and 44 via thrust bearings 47 and 48.

A swing cylinder 49 is for allowing the swing arm 42 to swing within a prescribed range of an angle about the threaded rod 33.

As shown in FIG. 6, the end of the swing cylinder 49 is movably connected with the end of an arm 50 extending from an intermediate position of the swing arm 42, and the end of a rod 51 of the swing cylinder 49 is movably connected with a projected piece 52 extending from the holding element 44. With such a structure, as the rod 51 goes into or comes out of the cylinder, the swing arm 42 is caused to swing within a prescribed range of an angle about the threaded rod 33.

Tube joints 53 and 54 are provided to allow a working fluid to flow into and out of the cylinder. Sensors 55 and 56 control the movement of the swing cylinder. The sensors 55 and 56 have each a reed switch built in, and the piston for the cylinder has a magnet put inside. When the piston has moved to the position of the sensor, the attractive force of the magnet causes the reed switch to close, which controls the valve for flow-in of the working fluid, etc. and thereby controls the movement of the swing cylinder 149.

Swing of the swing arm 42 driven by the swing cylinder 49 allows the mold-pushing cylinder 41 to swing within a prescribed range of an angle back and forth ranging from the position above the horn 30 to a position outside the horn 30.

A pressing element 58 is fixed at the lower end of a rod 57 or the mold-pushing cylinder 41. Lowering the rod 57 causes the runner section 59 of a mold placed on the horn 30 (FIG. 7) to get pinched between the pressing element 58 and the upper face of horn 30.

As shown in FIG. 7, the pressing element 58 is provided with a hole 60 opened to the lower face of the element so that a sprue section 61 may enter this hole 60. A sprue holding cylinder 62 contains a rod 63 whose tip may be pushed in and pulled out of the hole 60; a sprue section 61 will be pinched between the inner wall of the hole 60 and the tip of the rod 63 when pushed in.

An air blow inlet 64 is for blowing air into the hole 60. An air blow inlet 65 is for blowing air out from the lower face of the pressing element 58 (FIG. 6) to clean the upper face of the horn 30.

Tube joints 66 and 67 are provided to allow a working fluid to flow into and out of the mold-pushing cylinder 41. Sensors 68 and 69, like the sensors 55 and 56, controls the upper and lower positions for the vertical movement of the rod 57 of the mold-pushing cylinder 41. A regulator 70 is for adjustment of the pressure of the working fluid.

The operation of the apparatus with the above-described structure will be described below.

The apparatus if first set with the fixing element 40 at a suitable position, for example, where the mold taking-out device may place the mold directly onto the horn 30. Then, the position and height of the horn 30 is adjusted with the nut 39, the handle 38, etc. Finally, the holding elements 43 and 44 are adjusted so that the pressing element 58 is at a prescribed height over the horn 30 when the swing cylinder 49 is positioned at one of the swing stop positions. The preparation has now been completed.

For excution of cutting, a mold is first placed on the horn 30 by a mold taking-out device, etc. Then, the mold-pushing cylinder 41 is driven to lower the rod 57 until the runner section 59 of the mold (FIG. 7) comes between the pressing element 58 and the horn 30. Now, the vibratioal energy from the supersonic oscillator 32 is transmitted through the horn 30 to the gate section, i.e., the boundary between the runner section and the product to thereby cut the product at the gate section with the product dropping. The sprue catching cylinder 62 is driven to push the rod 63 into the hole 60 until the sprue section 61 is pinched between the tip of the rod 63 and the runner wall of the hole 60.

When the sprue-runner section has been caught by the pressing element 58, air is fed through the air blow inlet 65, blowing cut residues, etc. off the horn. The mold-pushing cylinder 41 is set to drive, raising the rod 57 and simultaneously the sprue-runner section. The swing cylinder 49 is now set to drive, the swing arm 42 is caused to swing by a prescribed angle about the threaded rod 33, and the sprue-runner section, kept held by the pressing element 58 as described above, is delivered to a position vertically out of the horn 30. At this position, the pressure on the sprue section by the sprue catching cylinder 62 and the rod 63 is released to drop the sprue-runner section for discharge. This drop of the sprue-runner section is preceded by a blow-in of air from the air blow inlet into the hole 60. This air blow-in secures the drop of the sprue section which is likely to adhere to the inner wall of the hole 60 by the action of static electricity, etc.

The mold for the next cutting is delivered over the horn by the mold taking-out device, etc. while the mold-pushing cylinder 41 and the pressing element 58 are positioned out of the horn 30, with a large space made available over the horn 30.

In the above sequence, the mold can be cut into the sprue-runner section and the product separated from each other.

In the embodiments described above, the oscillating mechanism containing the supersonic oscillator and the horn is disposed in the lower part of the apparatus and the pressing element is disposed over the oscillating mechanism. However, the present invention imposes no restriction on the orientation of these components; the oscillating mechanism may be disposed stationarily in the upper part of the apparatus (with the horn facing downward), with the pressing element disposed below the oscillating mechanism. Such a structure adopts upward movement of the pressing element for cutting, but with the same effect as the downward movement of the pressing element.

In the cutting apparatus according to the present invention, as described above, the oscillating mechanism containing the supersonic oscillator and the horn is disposed stationarily and the pressing element which may be made light and small is moved against the horn. Such a structure has made unnecessary the conventionally-adopted heavy guide device for the oscillating mechanism. leading to a success in making the overall apparatus small and light. On the other hand, the pressing element of light weight may be given a longer stroke and may be associated with a transfer mechanism to take the pressing element to outside the horn, so that such an ample space is made available to facilitate automatic delivery of molds onto the horn. In addition, since the pressing element is of light weight and supported by an air cylinder, etc., during the cutting process all the three bodies of horn, mold, and pressing element may readily be brought into resonance so that a large vibrational energy is transmitted to the mold being processed. Endowed with various features described above, the apparatus according to the present invention has an outstanding ability to cut even those molds which the conventional apparatus has failed to cut.

I claim:

1. A plastic mold cutting apparatus for cutting plastic mold by supersonic waves, comprising:

a base having an open surface, means for generating supersonic waves connected to the base, said means for generating supersonic waves including a supersonic oscillator, and a horn connected to the oscillator and having an upper end, said horn extending through the base so that the upper end of the horn is located adjacent to the upper surface of the base, means for pressing the plastic mold onto the upper end of the horn, said pressing means including a pressing element, a holder connected to the pressing element for holding at least a part of the plastic mold to be cut and a first moving device for vertically moving the pressing element with the holder, and means for supporting the pressing means including rails connected to the base, a support element connected to the rails and supporting the pressing means, and a second moving device connected between the base and the support element for moving the support element relative to the base, whereby after the plastic mold to be cut is placed on the upper end of the horn, said second moving device is actuated to locate the pressing element above the plastic mold, and then the first moving device is actuated to move the pressing element for holding the plastic mold between the pressing element and the horn, the plastic mold held between the pressing element and the horn being cut by the supersonic waves generated by the oscillator.

2. A plastic mold cutting apparatus according to claim 1, in which said base includes a hole, through which the horn passes to hold the plastic mold between the pressing element and horn, a part of the plastic mold being cut by supersonic waves passing through the hole.

3. A plastic mold cutting apparatus according to claim 2, in which said holder of the pressing means includes an elongated hole oriented toward the base for receiving therein a part of the plastic mold when the pressing means is located above the plastic mold, said pressing means further including a holding member connected to the holder and having a rod therein, said holding member, when the part of the plastic mold is located in the elongated hole, being actuated to retain the part of the plastic mold by means of the rod in the holder.

4. A plastic mold cutting apparatus according to claim 3, in which said holder of the pressing means further includes an air blow inlet, air being supplied to the air blow inlet when removing the part of the plastic mold from the elongated hole of the holder.

5. A plastic mold cutting apparatus according to claim 4, in which said pressing means further includes an air blow outlet to blow air onto the upper end of the horn for cleaning the same after the plastic mold is cut.

* * * * *